US005313200A

United States Patent [19]

Sone

[11] Patent Number: 5,313,200

[45] Date of Patent: May 17, 1994

[54] ROAD TRAFFIC CONGESTION DISPLAY SYSTEM

[75] Inventor: Gaku Sone, Tokyo, Japan

[73] Assignee: Nissan Motor Co., Ltd., Yokohama, Japan

[21] Appl. No.: 849,561

[22] Filed: Mar. 11, 1992

[30] Foreign Application Priority Data

Mar. 28, 1991 [JP] Japan ..... 3-90044

[51] Int. Cl.[5] ..... G08G 1/09; G08G 1/00

[52] U.S. Cl. ..... 340/905; 340/990; 340/995; 364/436; 364/437

[58] Field of Search ..... 340/905, 990, 995; 364/436–438, 443, 449, 424.01

[56] References Cited

U.S. PATENT DOCUMENTS 4,723,218 2/1988 Hasebe et al. ..... 340/990
4,937,570 6/1990 Matsukawa et al. ..... 340/995
5,020,143 5/1991 Duckeck et al. ..... 340/905
5,131,020 7/1992 Liebesny et al. ..... 340/905
5,132,684 7/1992 Pecker et al. ..... 340/990

FOREIGN PATENT DOCUMENTS 58-143370 8/1983 Japan .

OTHER PUBLICATIONS

"Smart Cars and highways go Global", Ronald K. Jurgen, IEEE Spectrum May, 1991 pp. 26–36.

*Primary Examiner*—Donnie L. Crosland
*Attorney, Agent, or Firm*—Lowe, Price, LeBlanc & Becker

[57] ABSTRACT

A display system mounted on a vehicle is designed to display a road map image around the vehicle with one or more directional congestion marks each indicating the position and direction of a congested traffic by receiving traffic information by radio communication. The directional congestion mark is in the form of an arrow or a series of arrows. Therefore, the driver can readily perceive the direction of a congested traffic.

11 Claims, 4 Drawing Sheets

ROAD TRAFFIC CONGESTION DISPLAY SYSTEM

BACKGROUND OF THE INVENTION

The present invention relates to a display system for providing traffic information to the driver of a vehicle such as an automobile.

Japanese Patent Provisional Publication No. (Sho) 58-143370 shows a conventional onboard road map display system for providing traffic information. This system displays congested road sections around the vehicle in colors so that the degree of congestion in each road section is perceptible. In this system, however, the driver is unable to correctly recognize whether a road section is congested in one direction or in the opposite direction.

SUMMARY OF THE INVENTION

It is an object of the present invention to provide a display system presenting a visual representation of the direction of traffic congestion so that the driver can readily know which of up and down directions is congested.

According to the present invention, a traffic congestion display system comprises a communicating means and a displaying means at least. The communicating means performs radio communication to receive traffic information. The communicating means may comprises an onboard antenna for receiving radio signals and an onboard receiver (or receiving circuit) connected with the onboard antenna. The displaying means displays at least one road map image on a screen, and at least one directional congestion mark indicating the direction of a road traffic congestion on the road map image. The displaying means may comprises a display unit such as a cathode ray tube display unit, a storage unit for storing map data, and an image processor, such as a microcomputer, for processing the map data and traffic information and controlling the display unit.

The directional congestion mark is designed to indicate the position and direction of a congested traffic. Therefore, driver can readily determine whether the road designated by the directional congestion mark is congested in one direction or in the other direction. The directional congestion mark may be in the form of an arrow or a series of arrows.

DETAILED DESCRIPTION OF THE INVENTION

Figure 1:
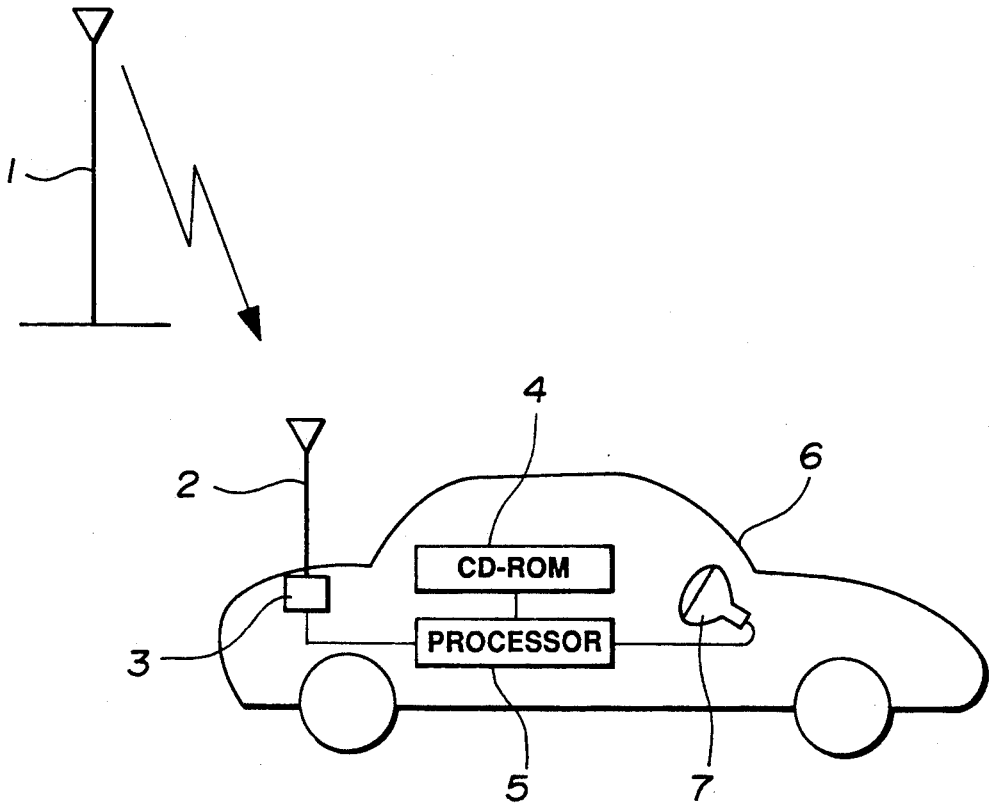
FIG. 1 is a block diagram showing a display system according to one embodiment of the present invention.

FIG. 1 shows a display system according to a first embodiment of the present invention.

There is provided a road system for monitoring traffic congestion. The road system comprises beacon transmitters 1 for transmitting information on location and road traffic congestion. The beacon transmitter 1 shown in FIG. 1 is mounted on a roadside support such as a post for traffic signals or illumination.

The display system of this embodiment has an onboard communicating system for receiving beacon waves from each of the beacon transmitters 1 of the road system. The onboard communication system of this embodiment includes an onboard beacon antenna 2 and a beacon receiver (or receiving circuit) 3 which are both mounted on a vehicle 6 such as a motor vehicle.

The display system of this embodiment further includes an onboard storage unit 4 for storing map data representing a road map or maps. In this embodiment, the storage unit 4 is a CD-ROM unit.

The display system further includes a map image processor 5 and a display unit 7. The processor 5 is connected with each of the beacon receiver 3, the CD-ROM unit 4 and the display unit 7. The processor 5 is designed to read the map data around the current vehicle position from the CD-ROM unit 4, and to form an image of a road map around the vehicle on a screen of the display unit 7 by sending electric signals to the display unit 7. The processor 5, moreover, receives traffic data on congestion from the beacon receiver 3, and displays one or more directional congestion marks indicating the position and direction of road traffic congestion on the screen of the display unit 7. As shown in FIG. 1, the beacon antenna 2, receiver 3, CD-ROM unit 4, processor 5 and display unit 7 are all mounted on the vehicle 6.

Figure 2:
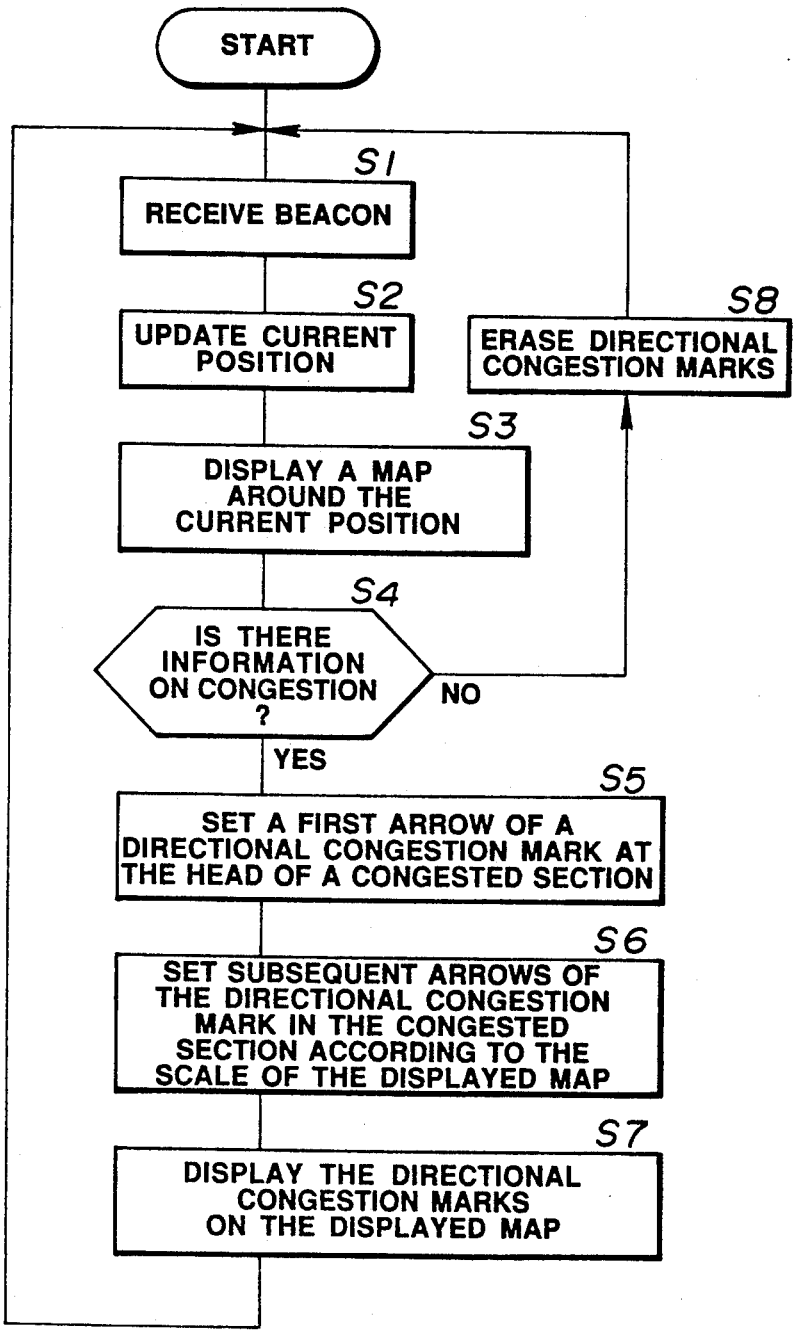
FIG. 2 is a flow chart of a control program used in the display system shown in FIG. 1.
Figure 3:
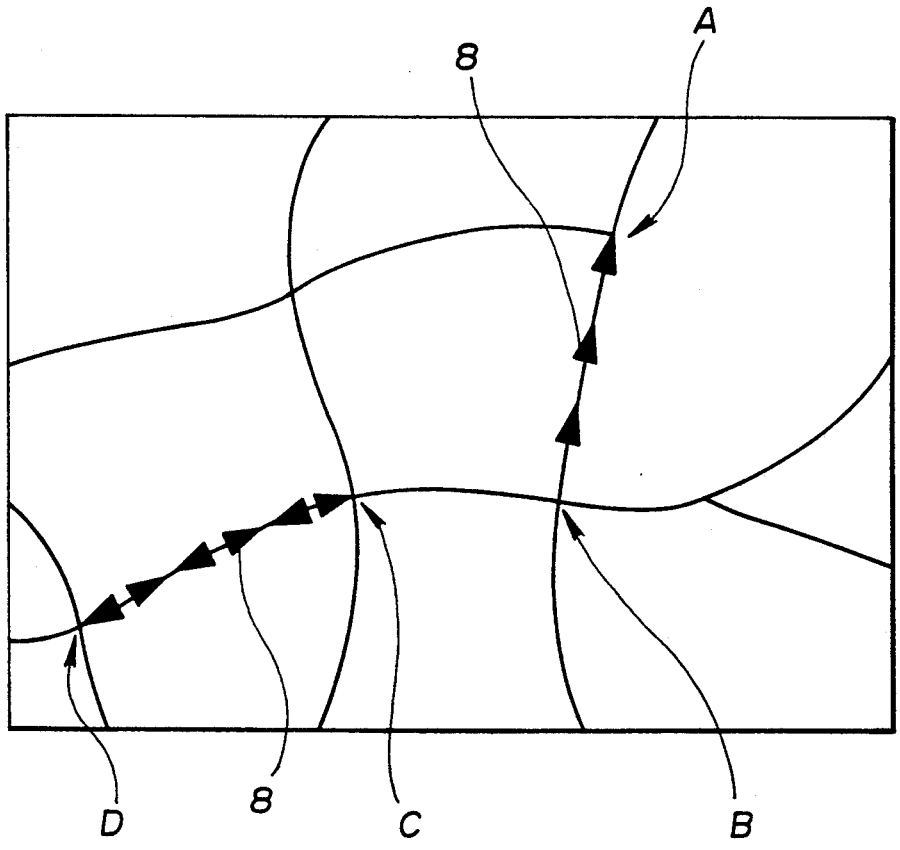
FIG. 3 is a schematic view showing, as an example, one road map image produced by the display system shown in FIG. 1.

The processor 5 of this embodiment performs a display control program shown in FIG. 2. FIG. 3 shows one example of road map images produced by the display system of this embodiment.

At a step S1 of FIG. 2, the processor 5 of the display system receives radio beacon by controlling the beacon antenna 2 and the beacon receiver 3. In this embodiment, the traffic information obtained from the road system at the step S1 includes one or more congestion data sets if there is any congestion. Each congestion data set includes a data item representing the position of a leading (front) end of a congested road section (or interval), a data item representing the direction of a congested traffic on that road section, and a data item representing the length of the congestion. For example, the display system obtains the information that a congested section extends from a road intersection (crossing) A toward a road intersection B, and that the length of the congestion is 3 km. The leading position of this congestion is located at the intersection A. The direction of the congestion is one of up and down directions on the road section. In this example, the traffic flow heading toward the intersection A from the intersection B is in a congested state, so that the congested traffic direction is from the intersection B to the intersection A. The traffic flow in the opposite direction from the intersection A to the intersection B is smooth.

At a next step S2, the processor 5 updates a current position of the vehicle 6 by using the location data contained in the information of the radio beacon. At a step S3, the processor 5 obtains the map data representing a road map around the current vehicle position from the CD-ROM unit 4, and produces a road map image around the current vehicle position on the screen of the display unit 7.

At a step S4, the processor 5 determines whether the information of the received radio beacon contains any congestion data or not. If there is at least one data set on traffic congestion in the information of the radio beacon, then the processor 5 proceeds from the step S4 to a step S5. If there is no congestion data in the received radio beacon, then the processor 5 proceeds to a step S8. In this case, the processor 5 erases the directional congestion mark or marks, if any, in the displayed road map image at the step S8, and then returns to the step S1. In this example, the directional congestion mark is in the form of an arrow or a series of arrows 8. The arrow 8 is a plane figure resembling an arrow or an arrowhead. The arrow 8 of this embodiment is a wedge-shaped plane figure.

At the step S5, the processor 5 finds out the position of the leading end (or head) of a congested road section (or each of congested road sections), and sets a first arrow 8 according to the direction of the congestion. At a next step S6, the processor 5 sets subsequent arrows 8 in the congested section (or each congested section) according to the length of the congestion. The number of the arrows 8 in the directional congestion mark is determined according to the scale of the displayed road map. When, for example, the road map is drawn on the display screen to a scale of 1/50000, one arrow 8 is placed for every one kilometer. On the scale of 1/25000, one arrow 8 is placed in each length of 500 m. Thus, the processor 5 determines the position and orientation of each arrow 8 in the map image on the screen. The arrows 8 in one congestion mark are arranged in a line at regular intervals, and directed in the same direction.

In the example shown in FIG. 3, the arrows 8 of the directional congestion marks are in the form of a triangle having one angle pointing the direction of the congestion. In the example of FIG. 3, the triangle is an isosceles triangle having two equal sides and a base shorter than the equal sides. The direction of congestion is indicated by the angle at the apex or the direction from the middle of the base to the apex. In this invention, it is possible to employ any of marks or figures suitable for indication of direction. In the map image of FIG. 3, the road section between the intersection (or crossing) A and the intersection (or crossing) B is congested only in one direction. The traffic flow in the opposite direction is smooth. In a road section between an intersection C and an intersection D, the traffic flows are hampered in both directions simultaneously. The congestion in the lane (or lanes) for vehicles heading toward the intersection C from the intersection D has its head (leading end) at the intersection C, and extends from the head to its downstream end near the intersection D. The head of the congestion in the opposite direction is located at the intersection D. The processor 5 places a first arrow 8 at the head of the congestions of each direction, and add an appropriate number of subsequent arrows 8 in each direction. The triangle-shaped arrows 8 in one direction and the opposite direction are arranged alternately with no overlap, as shown in the road section between C and D in FIG. 3.

At a step S7, the processor 5 displays the directional congestion marks 8 set at the steps S5 and S6 on the screen of the display unit 7. Then, the processor 5 returns to the step S1 to repeat the program. The processor 5 therefore updates the road map by receiving the radio beacon from the next transmitter, and uses the new traffic information to rearrange the directional congestion marks or to erase the existing congestion marks.

The system of this embodiment displays real time information on traffic congestion with the directional marks 8. Therefore, the displayed traffic information is accurate and reliable. The driver of the vehicle can select the best route to avoid traffic congestion and reduce waste of time and energy. Specifically, the driver can readily discriminate among a one way congestion in an up direction, a one way congestion in a down direction and a two way congestion in both directions. In the case of a two way congestion in which the lanes of up and down directions in the same road section are both congested simultaneously, the display system presents clear representation of the respective leading positions and intervals of the congested flows in both directions.

The traffic information received from the radio beacon transmitters may assume various forms. For example, information on a congested section may be given by a pair of a coordinate (x1, y1) designating the leading end of the congested section and a coordinate (x2, y2) designating the trailing end of the congested section according to a predetermined coordinate system on a road map.

Furthermore, it is optional to place a first arrow at the leading position of a congested section and a last arrow at the trailing end, and then add an appropriate number of intermediate arrows arranged at regular intervals between the first and last arrows.

The directional congestion mark of the present invention may be designed in various manners. For example, the number of the arrows in each congestion mark is increased or decreased in accordance with the degree of congestion such as traffic speed or traffic density. The arrows in a line may be arranged densely at shorter intervals when the degree of congestion is high, and sparsely when the degree of congestion is low. The directional congestion mark may be painted with one of different colors indicating different degrees of congestion. It is possible to use a microcomputer as a main component of the image processor 5, and a CRT display unit or a liquid crystal display unit as the display unit 7.

Figure 4:
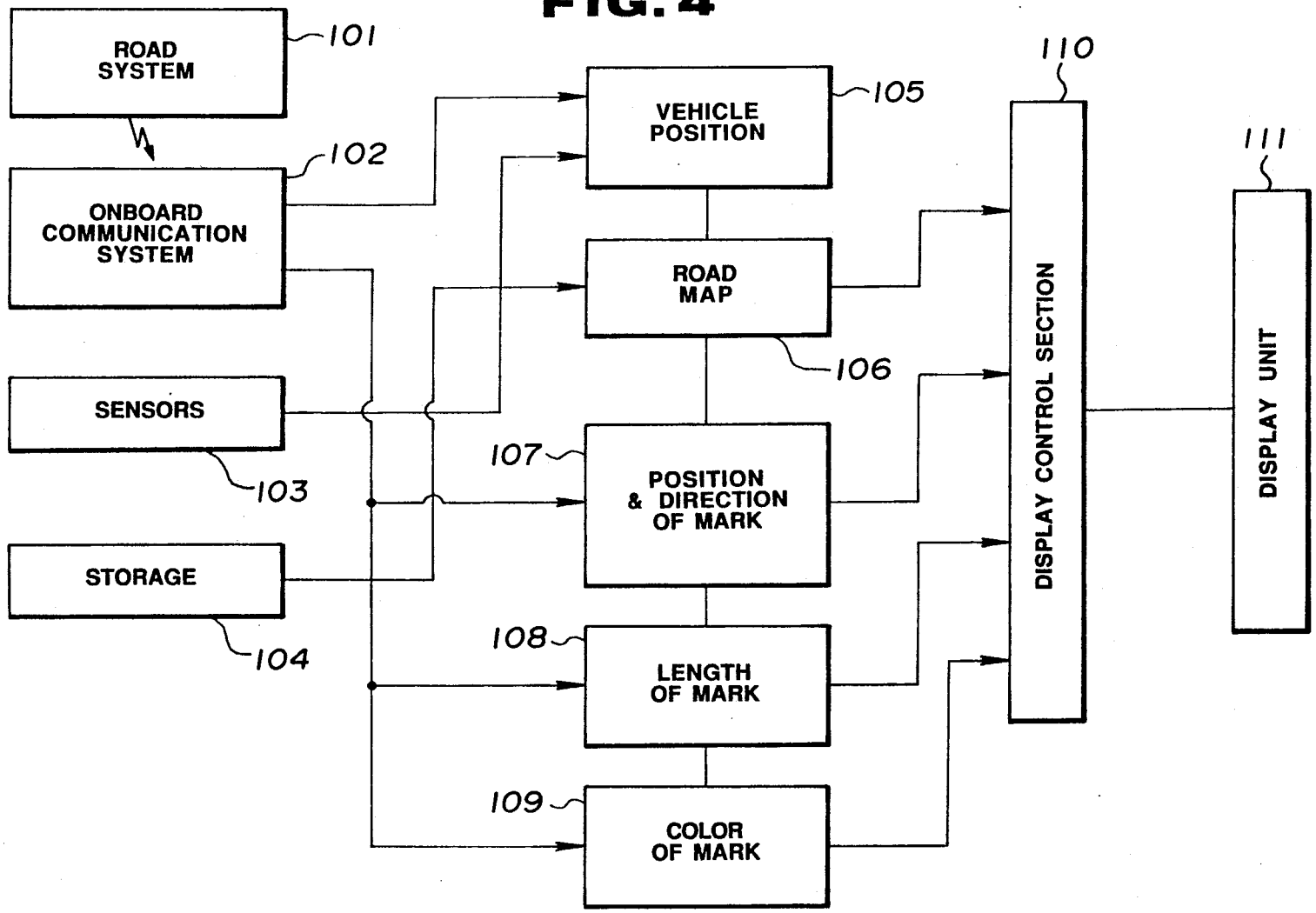
FIG. 4 is a block diagram showing a modification of the display system of FIG. 1.

In the first embodiment, the communicating means comprises the onboard antenna 2 and the receiver 3, and the displaying means comprises the CD-ROM unit 4, the processor 5 and the display unit 7. The display system according to the present invention may further comprise a sensing means 103, mounted on the vehicle, for sensing the travel direction and travel distance of the vehicle, as shown in FIG. 4.. The sensing means 103 shown in FIG. 4 comprises a magnetic direction sensor and wheel speed sensors. FIG. 4 shows a modification of the display system shown in FIGS. 1 and 2. The system shown in FIG. 4 includes a road system 101 for monitoring traffic congestions and transmitting traffic information through space, an onboard communication system 102 identical to the onboard communication system of the first embodiment, a storage means 104 such as the CD-ROM for storing map data, a map image processor, and a display unit 111 identical to the display unit 7 of the first embodiment. The processor shown in FIG. 4 comprises a means 105 for determining the current vehicle position, a means 106 for preparing data to draw a road map image around the current vehicle position, a means 107 for determining the position and direction of a directional congestion mark (or each of directional congestion marks), a means 108 for determining the length of the directional congestion mark (or each directional congestion mark), a means 109 for determining a color of the (or each) directional congestion mark, and a display control section 110 for delivering electric signals to the display unit 111. The current vehicle position can be determined either or both of the location data from the road system 101 and the data supplied from the sensing means 103. The current vehicle position determining means 105 corresponds to the step S2 of FIG. 2, and the road map data preparing means 106 corresponds to the step S3. The mark position and direction determining means 107 corresponds to the step S5, and the mark length determining means 108 corresponds to the step S6. The display control section 110 produces a road map image on the screen of the display unit 111 by delivering video signals to the display unit 111. The system of FIG. 4 employs the same directional congestion mark 8. The length of the directional congestion mark corresponds to the number of arrows in series.

What is claimed is:

1. A traffic congestion display system comprising:

a communicating means for receiving radio signals and for transmitting traffic information; and a displaying means for displaying a road map image on a screen, and a directional congestion mark indicating a direction of a road congestion in a road section on said road map image; wherein said communicating means and said displaying means are both mounted on a vehicle, said displaying means comprises a display unit comprising said screen, and an image processing means for controlling said display unit to display said road map image and said directional congestion mark which indicates a position of a congested road section and a congested traffic direction which is one of up and down directions in said congested road section, said up and down directions being opposite traffic directions along said congested road section, said direction congestion mark comprises at least one arrow and further indicates a length of a road traffic congestion with the number of said at least one arrow, and when the number of said at least one arrow is greater than one, said directional congestion mark comprises a plurality of the arrows which are arranged in a line segment at regular intervals and all directed to one end of said line segment.

2. A traffic congestion display system according to claim 1 wherein each arrow of said directional congestion mark is in the form of a triangle.

3. A traffic display system according to claim 1 wherein said image processing means includes a means for storing a collection of map data items representing a road map, means for determining a current vehicle position of said vehicle, means for producing a road map image around said current vehicle position by using said map data items, means for receiving said traffic information around said current vehicle position through said communicating means, means for examining said traffic information to determine whether said traffic information contains congestion data sets each of which is a set of data items indicating a congested road section, and means for producing said direction mark for each of said congestion data sets if said congestion data sets are contained in said traffic information.

4. A traffic congestion display system according to claim 3 wherein said image processing means includes a means for producing two of said directional marks a first one of which comprises a plurality of arrows in a first direction indicating a traffic congestion in a first direction in a road section and a second one of which comprises a plurality of arrows in a second direction indicating a traffic congestion in said second direction opposite to said first direction in said road section, said arrows in said first and second directions being arranged alternately along a line extending along said road section.

5. A traffic congestion display system according to claim 3 wherein said directional mark comprises a first arrow indicating a position of a leading end of a congested road section.

6. A traffic congestion display system according to claim 5 wherein said directional congestion mark comprises a last arrow indicating a position of a trailing end of said congested road section.

7. A traffic congestion display system according to claim 3 wherein said directional congestion mark has a shape indicating a direction of a congested traffic, a length indicating a length of a congested road section, and a color indicating a degree of a traffic congestion.

8. A traffic congestion display system according to claim 1 wherein said communicating means comprises an onboard antenna for receiving radio beacon and an onboard receiver, and said image processing means comprises a storage unit for storing a collection of map data items representing a road map, and a map image processor for controlling said display unit.

9. A traffic congestion display system according to claim 8 wherein said processor comprises a means for determining a position of a leading end of a congested road section, a direction of a traffic congestion, and a number of arrows representing a length of a traffic congestion by examining said traffic information, and displaying said directional congestion mark which consists of said arrows which are arranges at regular intervals along a line.

10. A traffic congestion display system according to claim 8 wherein said display system further comprises a road system for transmitting radio beacon to said onboard antenna.

11. A traffic congestion display system comprising:

a communicating means for receiving radio signals for transmitting traffic information; and a displaying means for displaying a road map image on a screen, and a directional congestion mark indicating a direction of a road congestion in a road section on said road map image;

wherein said communicating means and said displaying means are both mounted on a vehicle, and said displaying means comprises a display unit comprising said screen, and an image processing means for controlling said display unit to display said road map image and said direction congestion mark which indicates a position of a congested road section and a congested traffic direction which is one of up and down directions in said congested road section, said up and down directions being opposite traffic directions along said congested road section;

said image processing means including a means for producing two of said directional marks a first one of which comprises a plurality of arrows in a first direction indicating a traffic congestion in said first direction in a road section and a second one of which comprises a plurality of arrows in a second direction indicating a traffic congestion in said second direction opposite to said first direction in said road section, said arrows in said first and second directions being arranged alternately along a line extending along said road section.

* * * * *